United States Patent [19]

Fortier et al.

[11] Patent Number: 4,991,274

[45] Date of Patent: Feb. 12, 1991

[54] TOOL HOLDER FOR BURNISHING CUTTER

[76] Inventors: Ray Fortier, 148L LaBonne Vie Dr. West, East Patchogue, N.Y. 11772; Joseph V. Roebuck, P.O. Box 681, Middle Island, N.Y. 11953

[21] Appl. No.: 285,711

[22] Filed: Dec. 19, 1988

[51] Int. Cl.[5] ..... B41C 1/045; B24B 39/00

[52] U.S. Cl. ..... 29/90.01; 30/164.9; 51/109 R; 279/16; 409/228

[58] Field of Search ..... 29/90.01, 90.1, 90.3; 30/164.9; 51/109 R; 72/71; 279/16; 407/1, 9; 409/157, 180, 181, 182, 228, 229; 493/467

[56] References Cited

U.S. PATENT DOCUMENTS

| | | | |
|---|---|---|---|
| Re. 834 | 10/1859 | Sterer | 29/90.01 |
| 1,705,957 | 3/1929 | Braren | 30/164.9 |
| 2,744,329 | 5/1956 | Way et al. | 30/164.9 |
| 2,810,960 | 10/1957 | Johnson et al. | 30/164.9 |
| 2,902,760 | 9/1959 | Koenig | 30/164.9 |
| 3,353,273 | 11/1967 | Sicking et al. | 30/164.9 |
| 3,760,660 | 9/1973 | Van Arnam et al. | 29/90.01 |
| 4,044,464 | 8/1977 | Schiess et al. | 30/164.9 |

FOREIGN PATENT DOCUMENTS

| | | | |
|---|---|---|---|
| 933917 | 7/1949 | Fed. Rep. of Germany | 30/164.9 |

*Primary Examiner*—William E. Terrell

*Attorney, Agent, or Firm*—Alfred M. Walker

[57] ABSTRACT

A flexible tool holder for a burnishing cutter has a main body attachable to a rotatable member of an engraving machine, a tool holding element which is axially floatingly movable relative to the main body in an axial direction, and a spring which forces the tool holding element downwardly, so that during burnishing the tool holding element with the cutting tool connecting therewith moves up and down in response to surface irregularities of an engraving material.

1 Claim, 2 Drawing Sheets

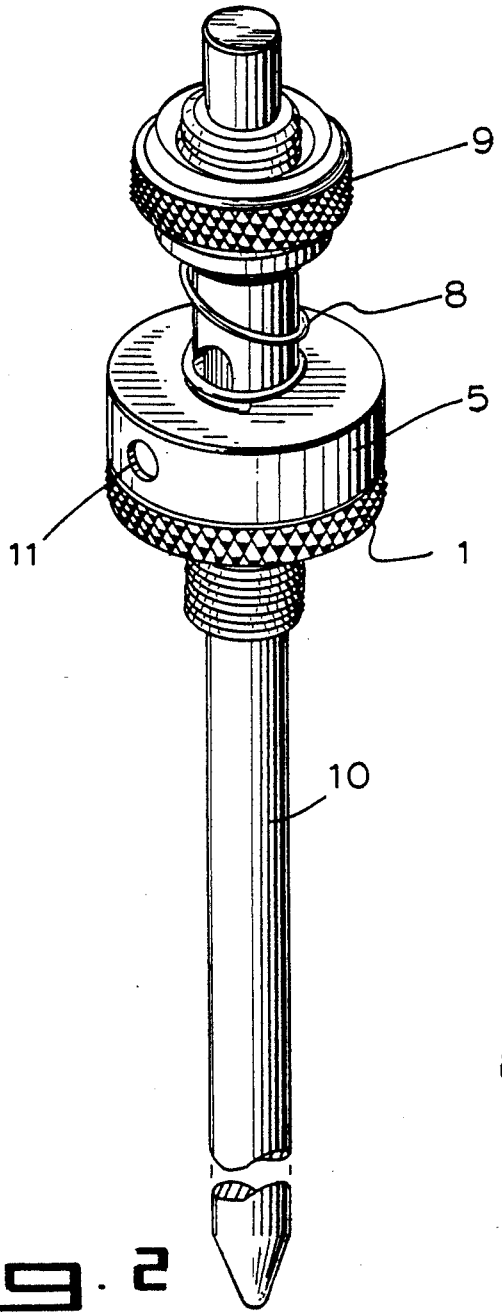
Fig. 1
Fig. 2A
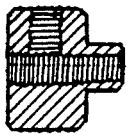
Fig. 2
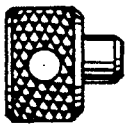

TOOL HOLDER FOR BURNISHING CUTTER

BACKGROUND OF THE INVENTION

The present invention relates to a flexible tool holder for burnishing cutters used in engraving machines.

Burnishing or cutting tools are mounted in a spindle of an engraving machine by means of fixed tool holders, referred to as cutter knobs, of various types. The burnishing process requires highly trained specialists for adjusting the entire engraving machine so as to control the exact downward pressure of the rotating cutting tool against the engraving material. If the material is not uniform in thickness or the table of the machine is not exactly flat, problems of cutting too deeply in the base metal or of missing spots completely can occur. In the known fixed holders, for adjusting the cutting tool the spindle is taken apart and put back together manually, to remove the spring holding a spindle. This is described in 1975 Sept./Oct. issue of "The Engravers' Journal", article "Burnishing: How to Get the Best Results". In accordance with another proposal disclosed in the article "Burnishing: Another Technical Problem Solved" in 1976 Jan./Feb. issue of the same magazine, a special clip is attached to the spindle, which compresses the spring so that the rotating cutting tool and the spindle are lowered. The clip is held in place by a lever screw which holds the spindle in position. This method, however, is complicated and difficult because of the pressure required to initially compress the spring tube. In both methods, the spindle must be lifted between characters engraved rather than depressed while engraving. Computers have also been used to measure the depth of rotating cutting tools; however, the operator must fine tune the cutting depth and downward pressure of the spindle to achieve the necessary delicate engraving pressure.

SUMMARY OF THE INVENTION

Accordingly, it is an object of the present invention to provide a flexible tool holder for a burnishing cutter, which avoids the disadvantages of the prior art.

More particularly, it is an object of the present invention to provide a flexible tool holder for a burnishing cutter, which makes the cutting tool responsive to surface irregularities of the engraving material, and therefore with minimal changes and calculations, the flexible cutting tool can operate under constantly changing surface conditions with a maximum efficiency.

In keeping with these objects and with others which will become apparent hereinafter, one feature of the present invention resides, briefly stated, in a tool holder which has a main body attachable to a spindle of a manual or computerized engraving machine, and tool holding element which is flexible relative to the main body and holds a cutting tool, and a spring which forces the tool holding element downwardly, so that the tool holding element together with the cutting tool connected therewith moves up and down in response to surface irregularities of an engraving material.

When the tool holder is designed in accordance with the present invention, it achieves the above specified objects.

The novel features of the present invention are set forth in particular in the appended claims. The invention itself, however, both as to its construction and its manner of operation will be best understood from the following description of a preferred embodiment which is accompanied by the following drawings.

BRIEF DESCRIPTION OF THE DRAWINGS

FIG. 1 is a perspective view of a flexible tool holder for burnishing cutter, in accordance with the present invention, with a portion of a cutting tool;

FIG. 2 is a side elevation of the adjusting member;

FIG. 2*a* is a cross section of the adjusting member;

DESCRIPTION OF A PREFERRED EMBODIMENT

Figure 3:
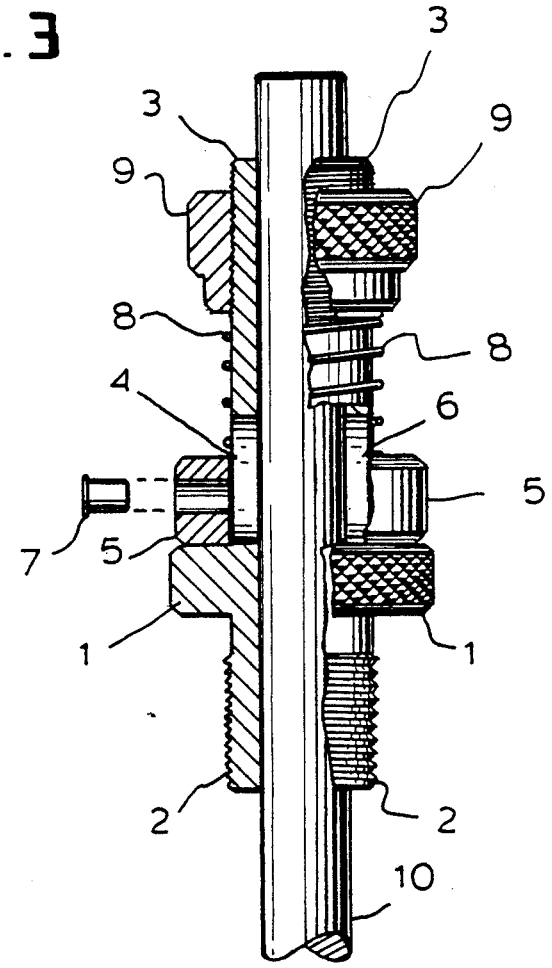
FIG. 3 is a cross section of the inventive flexible tool holder for the burnishing cutter.
Figure 4:
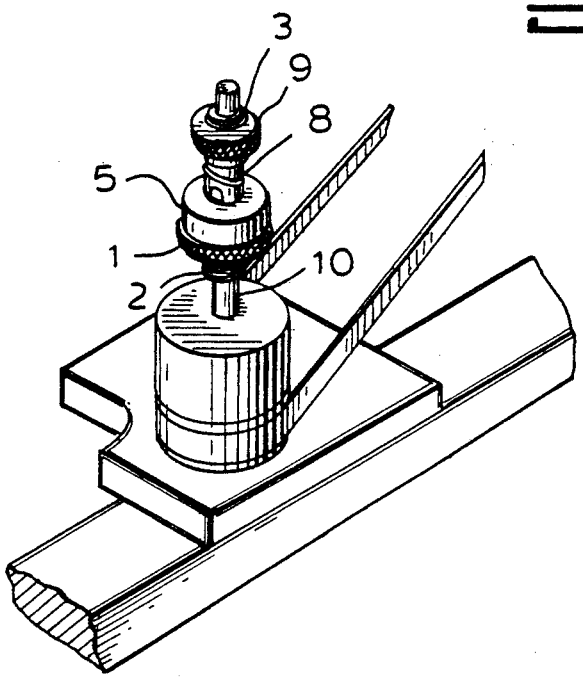
FIG. 4 is a view showing the inventive flexible tool holder with a cutting tool, installed in engraving spindle.

A flexible tool holder for a burnishing cutter used in a manual or computerized engraving machine in accordance with the present invention includes a main body provided with a knurled portion identified with reference numeral 1. The main body has two threaded areas 2 and 3 provided on its opposite ends. Two opposite elongated through holes 4 are machined in the walls of the main body as shown in FIG. 3. This figure clearly shows that the main body is a tubular member provided with the above listed formations. The lower thread 2 is preferably a left handed thread and used for attaching the main body to a rotary spindle 12 in a manual or computerized engraving machine.

A tool holding element 5 is movably seated on a central portion of the main body and can move in an axial direction of the latter. The tool holding element 5 is machined as a ring which is provided with a central opening 6 for receiving the central portion of the main body which a gap therebetween. The tool holding element 5 also has a threaded side hole for receiving a tool fixing set screw 7.

A spring 8 is fitted on the central portion of the main body above the tool holding element 5. It forces the tool holding element downwardly toward the knurled portion of the main body. The opposite end of the spring 8 abuts against an adjusting member 9 which adjusts the tension of the spring and is machined as a tension nut. The adjusting member 9 is displaceably held on the upper thread 3 of the main body.

The main body of the inventive tool holder is attached to the spindle of the engraving machine by means of the thread 2. A cutting tool 10 is fixed in the tool holder element 5 by the set screw 7 extending through the side hole 11 of the tool holding element. The spring 8 forces the tool holding element 5 together with the cutting tool 10 downwardly. During the burnishing process the cutting tool 10 together with the tool holding element 5 can be slightly pushed up against a force of the spring 8, when the cutting tool makes a contact with a material to be burnished or a raised portion of the latter. This prevents the operator from exerting too much pressure and engraving the metal too deeply. When the cutting tool burnishes a lowered portion of the material, the spring expands the tool holding element and therefore forces the cutting tool downwardly, thus preventing the operator from engraving the metal insufficiently deeply. Thus, the spring 8 provides an adjustable pressure against the cutting tool, irrespective how strong or lightly one depresses the tool holder.

The amount of pressure which the cutting tool exerts on the engraving material can be adjusted by the tension nut 9 by turning it clockwise or counterclockwise on the thread 3 of the main body. In response to this turning, the spring 8 is compressed or relaxed, thus exerting a respective varying pressure upon the tool holding element 5 and thereby upon the cutting tool 10. As a result, the cutting tool will exert higher or lower pressure on the material being burnished.

Lower pressure is necessary when burnishing metals with softer coatings such as a lacquer coating and soft metals like aluminum, since the burnishing process only removes the top coating and a very small portion of the actual metal, usually between 0.001 inch and 0.005 inch. Higher pressure is necessary for metals that have harder coatings such as enamels and harder metals such as brass.

Once the cutting tool 10 has been attached to the tool holding element 5, the latter may be installed. A gap of approximately 1/16 inch should appear between the knurled portion 1 and the tool holding element 5. If the gap is too large then the cutter has been advanced too far and needs to be adjusted. The gap which is too large will greatly increase the tension of the spring 8 and result in a deep cut, deeper than is needed to remove the coating. If the gap is too small there is not enough tension for the cutting tool to remove the coating. Once the gap is set, tension can be adjusted by loosening a set screw of the adjusting member 9, turning the latter in a desired direction, and then tightening the set screw. This causes a desired tensioning of the spring 8.

The invention is not limited to the details shown since various modifications and structural changes are possible without departing in any way from the spirit of the invention.

What is desired to be protected by Letters Patent is set forth in the appended claims.

I claim:

1. A flexible tool holder for a burnishing cutter, comprising a main body arranged to be attached to a rotatable member of an engraving machine and having a rotary axis;

a tool holding element arranged to be connected with a cutting tool and movable relative to said main body in an axial direction;

spring means arranged to force said tool holding element downwardly, so that during burnishing said tool holding element together with the cutting tool connected therewith moves up and down in response to surface irregularities of an engraving material;

said main body is machined as a tubular member so that the cutting tool can pass through an interior of said main body, said tool holding element being machined as a ring having a central opening for fitting on said main body and a side hole for passing a tool fixing member, said main body having at least one hole which can be brought in alignment with said hole of said tool holding element so that the tool fixing member can also pass through the hole of the main body;

said main body having means for threadably attaching to said rotatable member at the lower end of said main body;

an adjusting means for adjusting a tension of said spring means, said spring means being located between said adjusting means and said movable tool holding element, said adjusting means being located at the opposite, upper end of said main body with respect to said lower end of said main body.

* * * * *